US011473428B2

(12) United States Patent
Gaia et al.

(10) Patent No.: US 11,473,428 B2
(45) Date of Patent: Oct. 18, 2022

(54) AXIAL TURBINE WITH TWO SUPPLY LEVELS

(71) Applicant: TURBODEN S. p. A., Brescia (IT)

(72) Inventors: Mario Gaia, Brescia (IT); Roberto Bini, Brescia (IT)

(73) Assignee: TURBODEN S.P.A., Brescia (IT)

( * ) Notice: Subject to any disclaimer, the term of this patent is extended or adjusted under 35 U.S.C. 154(b) by 0 days.

(21) Appl. No.: 17/418,948

(22) PCT Filed: Dec. 20, 2019

(86) PCT No.: PCT/IB2019/061163

§ 371 (c)(1),
(2) Date: Jun. 28, 2021

(87) PCT Pub. No.: WO2020/136524

PCT Pub. Date: Jul. 2, 2020

(65) Prior Publication Data

US 2022/0112809 A1 Apr. 14, 2022

(30) Foreign Application Priority Data

Dec. 28, 2018 (IT) ..... 102018000021292

(51) Int. Cl.

| | |
|---|---|
| ***F01D 1/12*** | (2006.01) |
| ***F01D 1/02*** | (2006.01) |
| ***F01D 9/06*** | (2006.01) |
| ***F01D 25/26*** | (2006.01) |

(Continued)

(52) U.S. Cl.

CPC ..... *F01D 1/12* (2013.01); *F01D 1/02* (2013.01); *F01D 1/023* (2013.01); *F01D 5/14* (2013.01); *F01D 9/02* (2013.01); *F01D 9/06* (2013.01); *F01D 25/26* (2013.01); *F05D 2220/31* (2013.01); *F05D 2240/12* (2013.01); *F05D 2240/30* (2013.01)

(58) Field of Classification Search

CPC ... F01D 1/12; F01D 1/023; F01D 9/02; F01D 9/06; F01D 25/26; F05D 2220/31; F05D 2240/12

See application file for complete search history.

(56) References Cited

U.S. PATENT DOCUMENTS

| | | | | |
|---|---|---|---|---|
| 5,215,436 A * | 6/1993 | Puzyrewski | ..... | F01D 9/02 415/182.1 |
| 8,702,376 B2 * | 4/2014 | Mokulys | ..... | F01D 1/04 415/117 |
| 2022/0112809 A1 * | 4/2022 | Gaia | ..... | F01D 1/02 |

FOREIGN PATENT DOCUMENTS

| | | | |
|---|---|---|---|
| GB | 190916249 A | * | 11/1909 |
| JP | 58197401 A | * | 11/1983 |

* cited by examiner

*Primary Examiner* — Christopher R Legendre
(74) *Attorney, Agent, or Firm* — R. Ruschena Patent Agent, LLC

(57) ABSTRACT

An axial turbine (100) with two supply levels for the expansion phase of a working fluid in a thermodynamic vapor cycle or in an organic Rankine cycle comprising a shaft (2), a plurality of rotor blade arrays (R1-Rn) and corresponding support disks (21, 22), a plurality of stator blade arrays (S1-Sn), further comprising a first inlet opening (5) and a second inlet opening (7'). The second volute (4) is positioned inside the first volute (3), the working fluid of the second supply level reaching upstream of a stator blade (S2,Sn) that is are immediately upstream of one of the rotor blade arrays that extends radially into both of the first and second supply levels.

11 Claims, 4 Drawing Sheets

(51) Int. Cl.
*F01D 9/02* (2006.01)
*F01D 5/14* (2006.01)

AXIAL TURBINE WITH TWO SUPPLY LEVELS

BACKGROUND OF THE INVENTION

1. Field of the Invention

The present invention relates to multistage axial turbine having two supply levels, wherein the second supply fluid is carried out at any stage, downstream of the first stage and upstream of the last stage. Said turbine is used, in particular, for the expansion phase of vapor thermodynamic cycles, typically in an organic Rankine cycle (hereinafter also ORC from Organic Rankine Cycle). The turbine is also optimized in its assembly, as the assembly of the internal casing and of the various stages takes place with insertion from only one side of the turbine.

2. Brief Description of the Prior Art

As is known, a finite sequence of thermodynamic transformations (for example isothermal, isochoric, isobaric or adiabatic) is defined as a thermodynamic cycle, at the end of which the system returns to its initial state. In particular, an ideal Rankine cycle is a thermodynamic cycle consisting of two adiabatic and two isobaric transformations, with two phase changes, from liquid to vapor and from vapor to liquid. Its purpose is to transform heat into work. This cycle is generally adopted mainly in thermoelectric plants for the production of electric energy and uses water, both as liquid and vapor, as the engine fluid, and the corresponding expansion takes place in the so-called steam turbine.

In addition to the Rankine cycles with water as a working fluid, organic Rankine cycles (ORC) have been hypothesized and created which use high molecular mass organic fluids for the most diverse applications, in particular also for the exploitation of low-medium temperature thermal sources. As in other vapor cycles, the plant for an ORC cycle includes one or more pumps for feeding the organic working fluid, one or more heat exchangers for carrying out the preheating, vaporization and eventual overheating or heating phases in supercritical conditions of the same working fluid, a vapor turbine for the expansion of the fluid, mechanically connected to an electric generator or an operating machine, a condenser that brings the organic fluid back to the liquid state and a possible regenerator for recovering the heat downstream of the turbine and upstream of the condenser.

Particular attention is paid to the proper sizing and performance of the turbine since the ORC efficiency, as well as of a traditional water vapor cycle, mainly depends on the amount of mechanical work that the turbine is able to extract from the fluid flow.

For this reason, an effective solution consists of an axial turbine made with a plurality of stages, wherein each single stage again includes an array of stator blades and an array of rotor blades. In this way, the turbine is able to process greater enthalpy jumps. Furthermore, in order to use thermal cycles with double feeding at two different pressure levels, two different turbines are often used, each of which will process a different enthalpy jump.

Obviously, the use of two different turbines implies an important increase in the costs of the related plant, in addition to the presence of the two machines, also those of the related connection piping.

Furthermore, increasing the number of components of a plant inevitably reduces the overall reliability of the plant itself.

A second solution is to use a single turbine by providing two different supplies of the working fluid at different pressure levels.

For example, patent application US2009/0041577A1 describes a turbine of a turbocharger having two different inlet openings, the second of which supplies the working fluid downstream of the rotor distributor.

According to another example, patent application WO2017195094A1 describes a mixed axial-radial flow turbine, provided with a main inlet duct, one or more radial stages, one or more axial stages. The turbine is characterized in that an injection and/or an extraction of the organic working fluid takes place inside the array of angular stator blades.

Document EP3155225A1 discloses a turbine wherein at least one group of centrifugal stages, extends in a radial direction to carry out the centrifugal expansion of the operating fluid. Advantageously, the turbine comprises a group of stages, named centripetal stages, extending in a radial direction to carry out a first expansion of the operating fluid centripetally in the radial direction.

Document DE3242713A1 discloses a steam turbine, wherein the inlet housing is designed from two spiral housings which loop into one another. These spirals have annular openings (1', 2') which point towards the blade inlet, are arranged concentrically and extend over 360 DEG of the circumference.

Finally, document GB1015174A discloses an elastic fluid turbine, having a rotor with two bladed wheels for the first stage expansion, has separate inlets arranged to supply separate flows respectively to the two wheels, and a common passage arranged to receive the elastic-fluid from both wheels and direct it towards the inlet of a subsequent bladed wheel stage of the rotor.

The writer found of particular interest the possibility of realizing a supply at two different flow levels, that is characterized by the presence of a second flow with admission in one stage of the turbine downstream of the first one.

In axial turbines such solution can, however, lead to an increase of the axial development of the turbine, which can negatively affect the dynamic of the machine rotor, by lowering the first critical flexural frequency and then making it impossible to operate the turbine in a "rigid rotor regime" i.e., above its first critical vibration frequency. In particular, this can happen if the turbine disk or rotor disks are mounted overhanging the turbine shaft support bearings, as typically occurs in ORC organic fluid turbines.

There is a need, therefore to define for an axial turbine a double supply solution of the working fluid, that is free from the drawbacks mentioned above.

SUMMARY OF THE INVENTION

The aim of the present invention is to provide an axial turbine characterized by two supply flows which arrive upstream of a stage of said turbine parallel to each other, with an axial direction and being conveyed in two radially contiguous stators upstream of a subsequent common rotor, so that they do not require an increase in the axial dimension of the turbine.

With the second flow admission, two separate turbines and the related connection piping are avoided. The solution proposed is compact and does not alter the axial development of the turbine, such characteristic being particularly important for turbines having one mounting overhang of the disk or of the rotor discs.

Furthermore, the proposed solution is applied favorably to axial turbines in which the vapor supply casings are made in one piece or do not consist of two parts assembled with separation on a meridian plane.

In particular, the turbine comprises a first outer casing, inside which there is an internal casing so that the two boxes are positioned one inside the other and that the second fluid supply is made upstream of an array of stator blades, but still downstream of the first stage and upstream of the last stage.

Therefore, according to the present invention, an axial turbine is provided and, in particular, an axial turbine having two supply levels with the characteristics set out in the independent claim, attached to this description.

Further preferred and/or particularly advantageous embodiments of the invention are described according to the characteristics set out in the appended dependent claims.

BRIEF DESCRIPTION OF THE DRAWINGS

The invention will now be described with reference to the attached drawings, which illustrate some non-limiting examples of embodiments, wherein.

DETAILED DESCRIPTION OF THE PREFERRED EMBODIMENTS

The invention relates to a turbine including a shaft supported by at least two bearings and a plurality of expansion axial stages, defined by arrays of stator blades alternating with arrays of rotor blades. The rotor blades are supported by corresponding support discs.

In the context of the present invention, as is common in the field of turbines, reference is made to a system of axial symmetric coordinates in which a generic plane on which the axis of rotation of the turbine shaft lies is called the meridian plane. The direction orthogonal to the axis of the machine and lying in the considered meridian plane is defined as radial direction. With the term of a tangential direction in a point of a meridian plane the direction is indicated which is orthogonal to the meridian plane and orthogonal to the radial direction passing through the point. A direction parallel to the X axis of the machine is called the axial direction.

Figure 1:
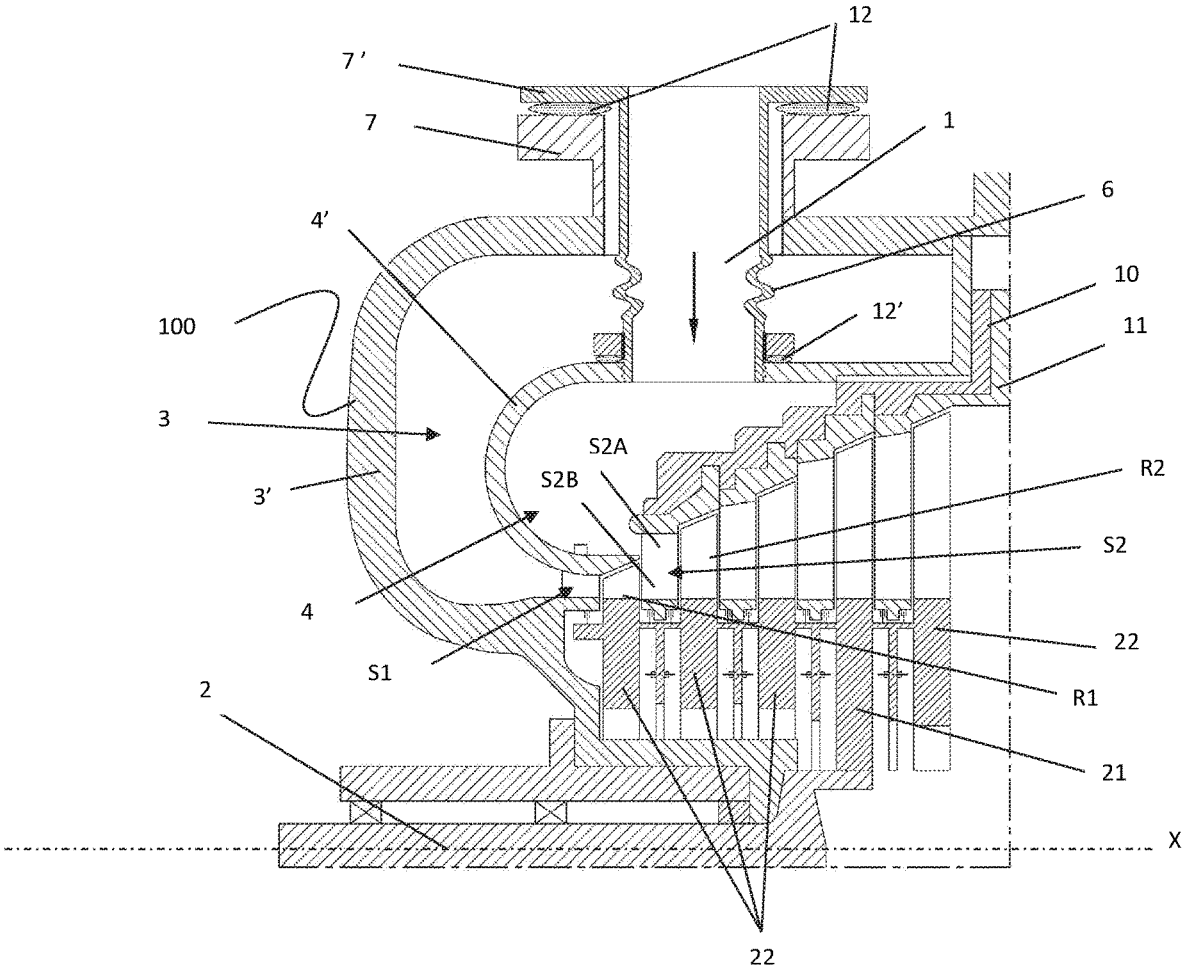
FIG. 1 is a partial section of a multistage axial turbine provided with two supply levels of a working fluid, according to a first embodiment of the present invention.
Figure 2:
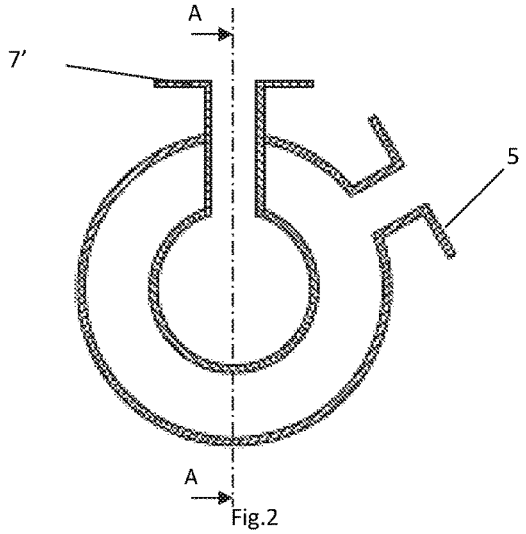
FIG. 2 is a plan view of the multistage axial turbine of FIG. 1.

FIG. 1 is a partial view, in an axial symmetrical section, of an axial turbine 100 in a multistage configuration as described in the previous applicant patent N. WO2016157020A2.

As shown in the Figure, at least one of the rotor disks 21 of the turbine, the main support disk, is directly coupled to the shaft 2, in an external position with respect to the bearings, ie in a non-intermediate region between the bearings, and the remaining rotor disks 22 are constrained to the main rotor disk, in succession one another, but not directly constrained to the shaft. In other words, the main support disk is preferably the only one which extends towards the axis of the turbine, until touching the shaft.

Therefore, the turbine 100 has a overhanging configuration with the arrays of rotor blades supported by the shaft, but at a region outside the bearings, without however renouncing to have a plurality of stages, even more than three if desired. Therefore, the turbine can be configured to expand the working fluid with a high enthalpy jump, corresponding to that obtainable with traditional axial turbines either with several stages, but not overhanging, or with two coupled axial turbines, other conditions being the same.

The same turbine will be used as a non-limiting example to describe the embodiments of the present invention.

In FIG. 1, as will be specified in the following, the turbine 100 is of the axial type and comprises a system for feeding the working fluid 1 to a shaft 2 which extends in the axial direction X, a first casing 3' defining an outer volute 3 and a second casing 4' defining an internal volute 4, a plurality of arrays of stator blades S1-Sn and rotor blades R1-Rn mutually alternating with each other, that is, arranged according to the scheme S1-R1; S2-R2; Sn-Rn, and so on, where "n" represents a generic stage (in FIG. 1 the number of total stages is five).

In addition, the proposed solution is favorably applied to axial turbines in which the vapor supply casings are made in a single piece, that is they are not constituted by two parts assembled with a separation on a meridian plane. This involves a significant simplification in the realization of the casings themselves but requires mounting the turbine by inserting the various parts that compose it, all on the same side of the turbine (in the Figures the mounting takes place with the insertion of the internal parts from the right to the left, ie from the discharge side of the turbine towards the vapor inlet side).

In particular, the turbine 100 is configured for working with two supply levels: the first flow enters the turbine in the traditional way, through a first inlet opening 5, flows through the outer volute 3 and reaches the first stage of the turbine; the second flow enters the turbine from a second inlet opening 7', flows along the internal volute 4, positioned internally to the outer volute 3 and reaches any stage of the turbine, downstream of the first stage. In particular, the two parallel supply flows with axial direction are conveyed in two radially contiguous stators S2A and S2B upstream of a subsequent common rotor R2 (FIG. 1).

For example, FIG. 1 shows the admission of the second flow upstream of the second stage S2-R2 but, as mentioned, it could take place in any stage subsequent to the first one.

Preferably, contiguous radial stator blades are mutually integrated to form a single blade, as shown in FIG. 1, whereas the S2A and S2B portions have no solution of continuity and form the stator blade S2.

Preferably, the adjacent stator blades extend through a groove and a shape of the channel is such to guarantee the discharge of the flows substantially with equal speed and angle of discharge in order to minimize the fluid dynamic losses in the subsequent rotor.

Advantageously, the assembly of the internal volute 4 and of the various stages Sn takes place with the insertion of the volute 3 from one side only.

Advantageously, each volute 3, 4 is made of a single piece, except for the inlet opening 7' of the internal volute 4 which is removable to allow its assembly. The inlet opening 7' is removable and can be fixed, screwed as shown in FIG. 1 or flanged as in FIG. 3 by using screws passing from the inside 9, up to the opening 7'. A seal 12 is positioned between the flange of the fixed opening 7 and the flange of the removable opening 7'.

A similar gasket 12' is preferably inserted between the opening 7' and the casing 4' in order to improve the seal between the 2 coupled parts.

Furthermore, the removable opening 7' is equipped with a bellows 6 to compensate for the displacements between the internal volute 4 and the external volute 3.

Figure 4:
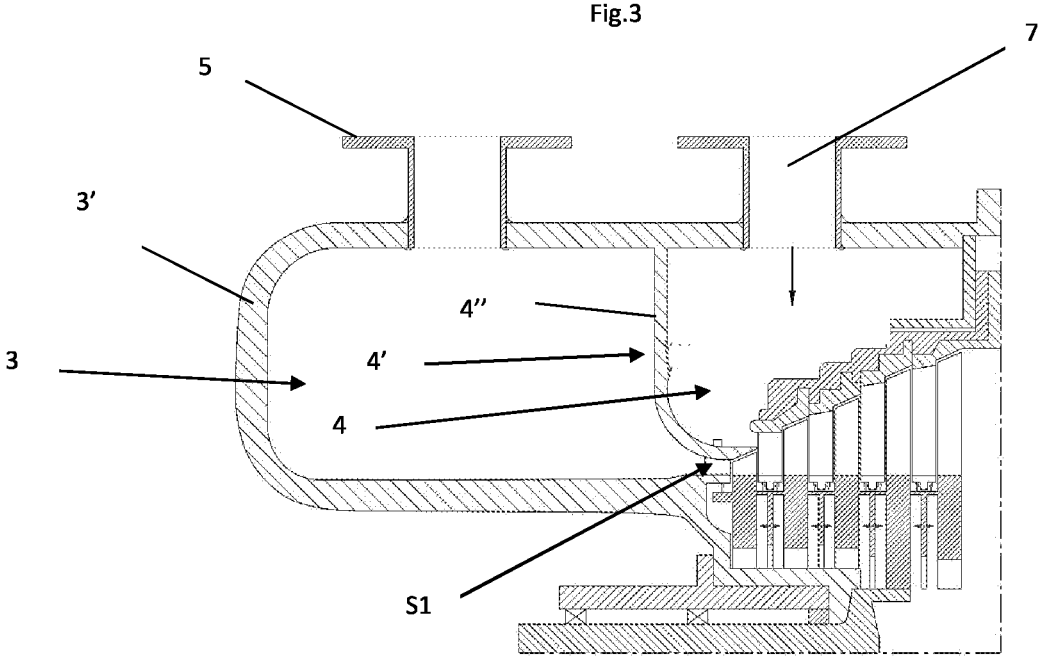
FIG. 4 is a partial section of the multistage axial turbine provided with two supply levels of a working fluid, inside the axial turbine, according to a third embodiment of the present invention.

According to an alternative configuration, as shown in FIG. 4, both of the inlet openings 5, 7 are mounted on the outer volute 3 and it is not expected, as not necessary, the presence of the internal opening 7'. The turbine according to this embodiment comprises a stator holder septum 4" which creates the internal casing 4' and defines the internal volute 4 mounted between the 2 openings so as to identify the area of the second admission.

Advantageously, the internal casing 4' rests on the first stator S1 for centering said casing 4' with respect to the external one 3, with the blade of the first stator S1 fixed to the internal volute 4 or to the external volute 3.

The advantage resides in the fact that in order to limit the radial displacement between the apex of the rotor blades and the fixed part (which displacement could generate an interference between the parts, except a significant clearance which is left and would in any case represent an efficiency loss), it is advisable that fixed parts are centered with respect to the outer casing 3' which is the one on which the shaft carrying the turbine bearings is also mounted. In this way, any thermal or mechanical deformations of the casing 3' entail similar movements of the stator parts connected to it, by keeping the aforesaid clearances practically constant.

Figure 3:
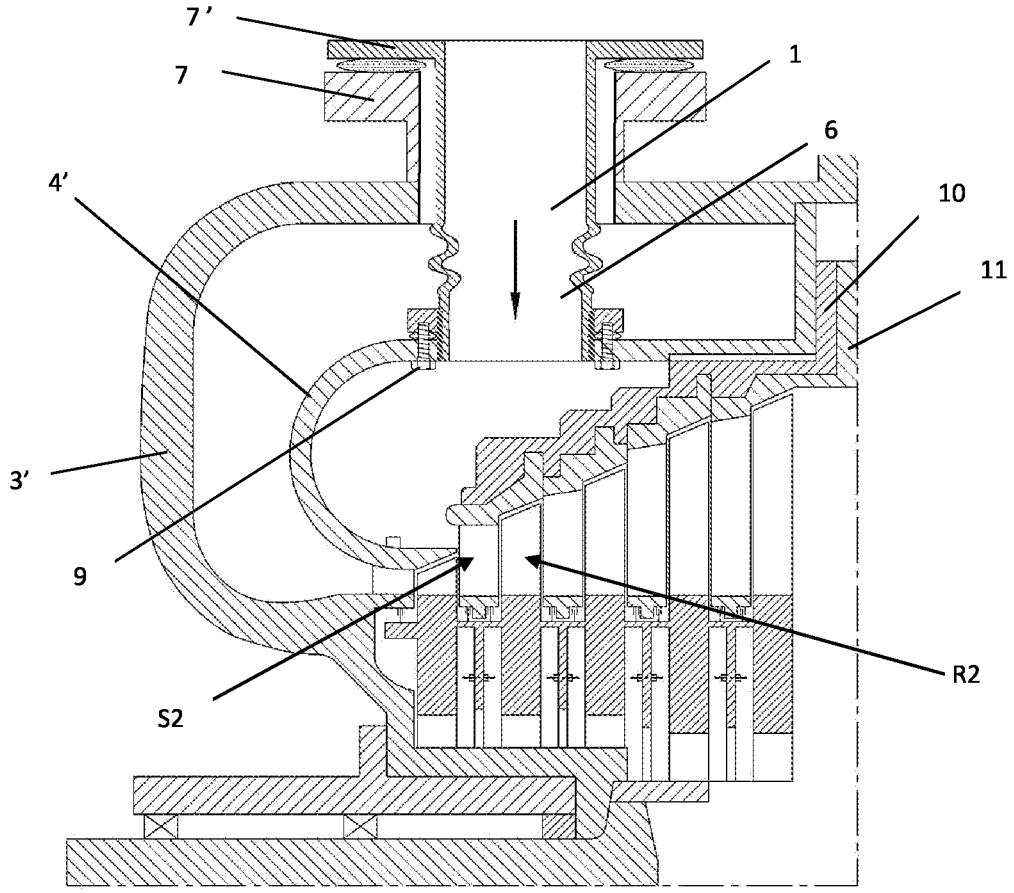
FIG. 3 is a partial section of the multistage axial turbine provided with two levels of admission of a working fluid, in a second embodiment of the present invention.

According to an alternative configuration, the stator rings 10, 11 on which the arrays of stator blades are mounted, subsequent to the mixing one, are in turn mounted on the outer casing 3' or on the inner one 4', such last solution being in FIG. 1 and FIG. 3.

Returning to the description of the array of stator blades inside of which the mixing of the two flows takes place, the stator blade of this stage may be a single mixing stator blade 13 with a projection 13' leaning to the internal volute 4' by making the centering between the stator rings of the subsequent stages and the internal volute 4'.

Figure 5:
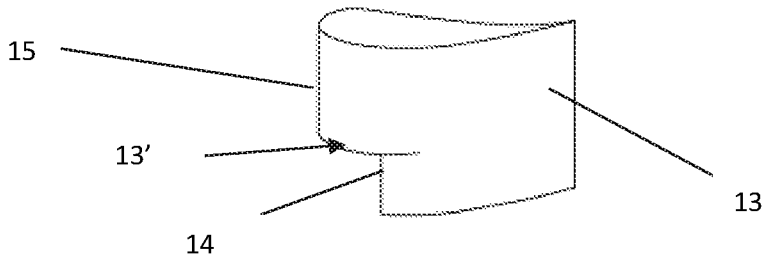
FIGS. 5 and 6 show the detail of a stator blade of the stage to which the two supply flows are conveyed.
Figure 6:
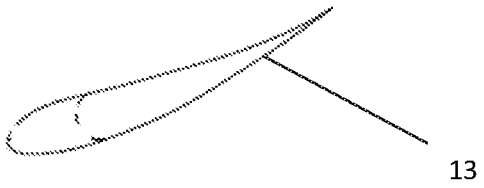

As shown in FIGS. 5 and 6, the mixing stator blade 13 can have a double leading edge 14 and 15 obtained for example by mechanical machining of the leading edge of the mixing stator blade 13. The two resulting inlet edges 14, 15 preferably have the same curvature at the point of separation between the two profiles in order to ensure a better conveying of the two flows.

Figure 7:
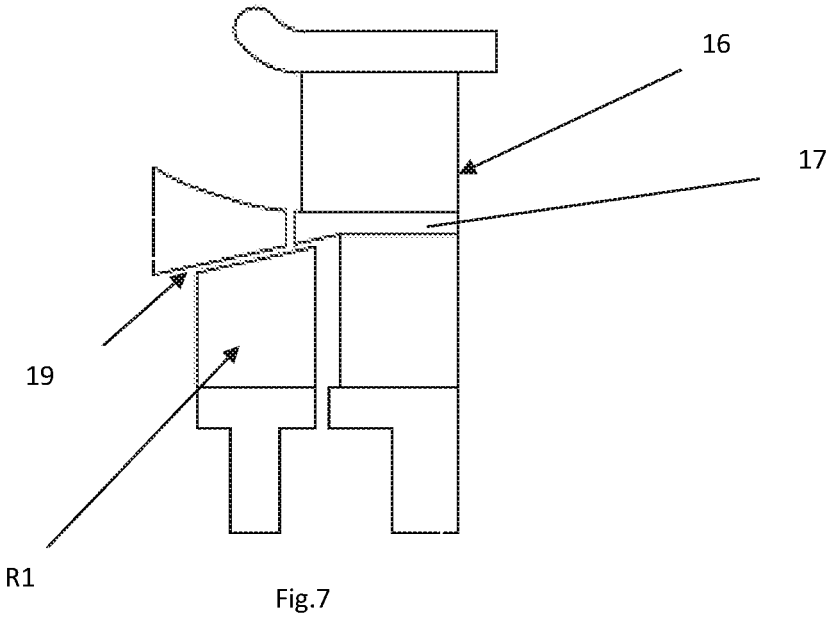
FIG. 7 shows details of a stator blade connecting the two volutes according to one of the preceding turbines, in a fourth embodiment of the present invention.

Furthermore, as shown in FIG. 7, a solution with a high pressure rotor blade R1 upstream of the stator-mixer having a flare 19 on the external part of the blade is also possible to give consistency to the final part (lip) of the internal volute.

Thanks to this inclination, in fact, the thickness of the lip increases by moving from the final outlet part of the lip itself.

In the same FIG. 7, it is observed that a further solution could provide a single mixing stator blade 16 with a separate stator-mixer in 2 channels (by means of an intermediate thin blade 17) to allow for an orderly mixing of the two flows.

Figure 8:
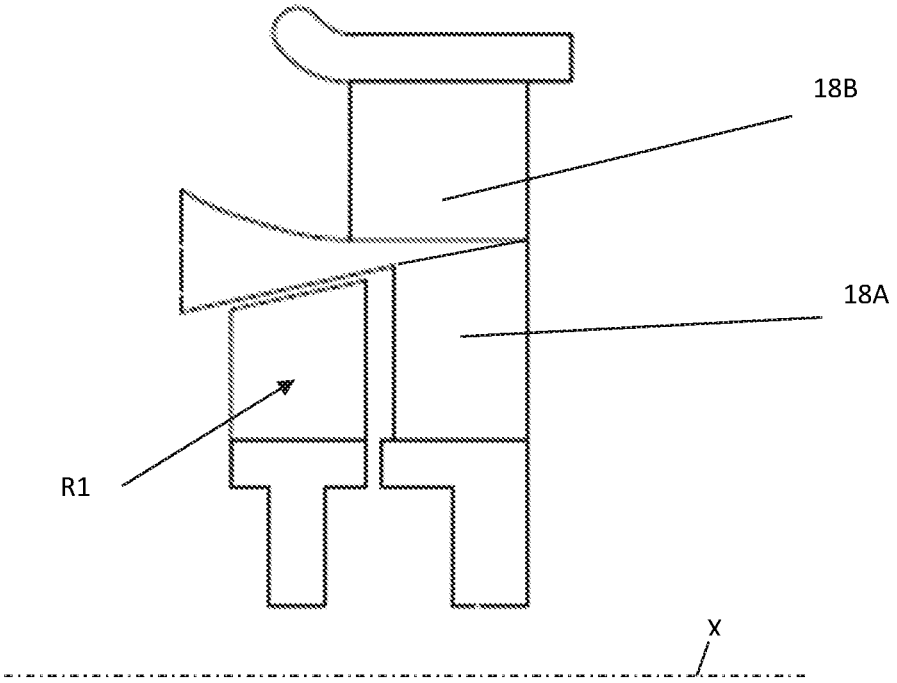
FIG. 8 shows a detail of the stator blade connecting the two volutes, in a fifth embodiment of the present invention.

As shown in FIG. 8, a further solution could envisage a stator mixing blade 18 realized in two parts 18A, 18B of which the inner one 18A, which is closer to the rotation axis X of the turbine, is welded to the flap 18C of the internal casing 4', whereas the external one 18B is resting on the flap of the internal casing 4'.

In addition to the embodiments of the invention, as described above, it is to be understood that there are numerous further variants. It must also be understood that said embodiments are only examples and do not limit neither the aim the invention, nor its applications, nor its possible configurations. On the contrary, although the above description makes it possible for the skilled man to implement the present invention at least according to an exemplary configuration, it must be understood that numerous variations of the described components are conceivable, without thereby leaving the object of the invention, as defined in the attached claims, interpreted literally and/or according to their legal equivalents.

The invention claimed is:

1. An axial turbine (100) having two supply levels for the expansion phase of a working fluid in a steam thermodynamic cycle or in an organic Rankine cycle comprising:
- a shaft (2),
- a plurality of stages, each stage having:
  - a rotor blade array (R1-Rn) with a corresponding support disk (21, 22), and
  - a stator blade array (S1-Sn);
- a first inlet opening (5) and a first inlet volute (3), defined by a first casing (3'), for a working fluid of a first supply level of the two supply levels, and
- a second inlet opening (7') and a second inlet volute (4), defined by a second casing (4'), for a working fluid of a second supply level of the two supply levels, wherein
- the second inlet volute (4) is positioned inside the first inlet volute (3),
- the working fluid of the second supply level bypasses at least a first stage of the plurality of stages and
- the working fluid of the first supply level and the working fluid of the second supply level are conveyed to two radially contiguous stators that are immediately upstream of one of the rotor blade arrays that extends radially into both of the first and second supply levels.

2. The axial turbine (100) according to claim 1, configured in that an installation of the second casing (4') and the stator blade arrays takes place by inserting the second casing (4') and the stator blade arrays (S1-Sn) from only one side of the first casing (3').

3. The axial turbine (100) according to claim 1, wherein the two radially contiguous stators (S2A, S2B) form a single blade.

4. The axial turbine (100) according to claim 1, wherein each of the first casing and the second casing are made of a single piece.

5. The axial turbine (100) according to claim 1, wherein the second inlet opening (7') is removable and is fixed to a bellows (6) to compensate for displacements between the second casing (4') and the first casing (3').

6. The axial turbine (100) according to claim 1, wherein the second inlet opening (7') is mounted on the first casing.

7. The axial turbine (100) according to claim 6, further comprising a septum (4") supporting a stator of the stator blade arrays, said septum being mounted between the first and second inlet openings (5, 7') so as to define the second inlet volute (4) and an area of a second admittance to said second inlet volute (4).

8. The axial turbine (100) according to claim 1, wherein the second casing (4') rests on a first array of the stator blade arrays (S1-Sn) to achieve centering of the second casing (4') with respect to the first casing (3').

9. The axial turbine (100) according to claim 1, further comprising stator rings (10, 11) on which the two radially contiguous stators are mounted.

10. The axial turbine (100) according to claim 1, wherein said two radially contiguous stators form a mixing stator blade that has two inlet edges (14, 15), having the same curvature at a separation point.

11. The axial turbine (100) according to claim 1, wherein said two radially continguous stators form a mixing stator blade (16) made of two parts (18A, 18B) of which an inner one (18A), closer to a rotation axis (X) of the turbine, is welded to the edge of the second casing (4').

* * * * *